US009809974B1

(12) United States Patent
Brekke

(10) Patent No.: US 9,809,974 B1
(45) Date of Patent: Nov. 7, 2017

(54) ADJUSTABLE DECK TENSION TIE

(71) Applicant: Columbia Insurance Company, Omaha, NE (US)

(72) Inventor: Steve Brekke, Lakeville, MN (US)

(73) Assignee: Columbia Insurance Company, Omaha, NE (US)

( * ) Notice: Subject to any disclaimer, the term of this patent is extended or adjusted under 35 U.S.C. 154(b) by 0 days.

(21) Appl. No.: 15/214,869

(22) Filed: Jul. 20, 2016

(51) Int. Cl.
*E04B 1/38* (2006.01)
*E04B 1/41* (2006.01)
*E04B 1/00* (2006.01)

(52) U.S. Cl.
CPC ..... *E04B 1/40* (2013.01); *E04B 1/003* (2013.01); *E04B 2001/405* (2013.01)

(58) Field of Classification Search
CPC ..... E04B 1/40; E04B 1/003; E04B 2001/405
USPC ..... 52/698, 702, 708, 715, 712
See application file for complete search history.

(56) References Cited

U.S. PATENT DOCUMENTS 4,192,118 A * 3/1980 Gilb ..... E04B 1/0007 52/714
4,223,866 A * 9/1980 Black ..... E04G 17/18 249/211
4,423,977 A * 1/1984 Gilb ..... E04B 1/2608 403/232.1
4,811,542 A 3/1989 Jewell
5,004,369 A * 4/1991 Young ..... E04B 1/2612 403/232.1
5,058,358 A * 10/1991 Stratton ..... E04B 1/2612 248/214
5,092,097 A * 3/1992 Young ..... E04B 1/2608 52/264
5,186,571 A * 2/1993 Hentzschel ..... E04B 1/2608 256/65.06
5,190,268 A * 3/1993 Espinueva ..... E04H 17/1421 256/65.01
5,217,317 A * 6/1993 Young ..... E04B 1/2612 403/14
5,457,928 A * 10/1995 Sahnazarian ..... E04B 1/2612 403/232.1

(Continued)

OTHER PUBLICATIONS

USP Structural Connectors 2015-2016 Product Catalog, © 2015 MiTek All rights reserved, Jun. 2015 USP2330, (3) pgs.—front cover, p. 213 and back cover.

(Continued)

*Primary Examiner* — Brent W Herring
(74) *Attorney, Agent, or Firm* — Senniger Powers LLP

(57) ABSTRACT

An adjustable deck tie bracket includes a front plate having an opening. Legs are on opposite sides of the front plate. A deformation zone connects a brace member to the front plate. The deformation zone has less resistance to bending than the brace member to facilitate rotation of the front brace by deformation at the deformation zone. To connect a deck to a house, a connector can be inserted through the front plate and secured to an anchor in the house. The orientation of the brace member is adjusted so it so extends to the bottom of a deck joist, thereby allowing flexibility in the vertical spacing between the connector and the deck joist. The legs are secured to opposite sides of the deck joist and the brace member is secured to the deck joist at a location that is spaced farther from the house than the legs.

19 Claims, 11 Drawing Sheets

(56) References Cited

U.S. PATENT DOCUMENTS 5,467,570 A * 11/1995 Leek ..... E04B 1/2608 403/190
5,670,076 A * 9/1997 Leek ..... E04G 21/185 249/219.1
5,797,694 A * 8/1998 Breivik ..... E04B 1/2608 403/231
6,250,041 B1 * 6/2001 Seccombe ..... E04B 1/2604 403/190
6,311,449 B1 11/2001 Morse et al.
6,397,552 B1 6/2002 Bourque
7,200,972 B1 * 4/2007 Freeman ..... E04C 3/005 52/641
7,254,926 B2 8/2007 Eldeen
7,513,083 B2 * 4/2009 Pryor ..... E02D 27/42 403/232.1
7,533,508 B1 * 5/2009 diGirolamo ..... E04B 2/58 248/300
8,234,826 B1 * 8/2012 Proffitt, Jr. ..... E02D 27/00 52/293.3
8,387,321 B2 * 3/2013 diGirolamo ..... E04B 2/58 52/241
8,387,333 B2 3/2013 Brekke
8,443,569 B2 * 5/2013 Sias ..... E04B 7/063 248/300
8,555,580 B2 * 10/2013 Vilasineekul ..... E04B 1/2604 52/293.3
9,045,895 B1 * 6/2015 Lin ..... F16B 15/0053
9,145,669 B1 9/2015 Broughton
9,151,058 B1 * 10/2015 Leathe ..... E04B 1/2608
2002/0078656 A1 * 6/2002 Leek ..... E04B 1/2612 52/702
2002/0112439 A1 * 8/2002 Rosas ..... E04B 1/2608 52/712
2002/0124483 A1 * 9/2002 Rosas ..... E04B 1/2608 52/92.2
2005/0160683 A1 * 7/2005 Eldeen ..... E04B 1/003 52/73
2007/0294979 A1 * 12/2007 Lin ..... E04B 1/2612 52/702
2014/0338282 A1 * 11/2014 Sidhu ..... E04C 3/04 52/702

OTHER PUBLICATIONS

Simpson Strong Tie Technical Bulletin, Installation Options for Deck Lateral Load Connections, © 2015 Simpson Strong-Tie Company Inc. T-C-DECKLAT15 Feb. 2015 exp. Jun. 17, (4) pgs.

* cited by examiner

ADJUSTABLE DECK TENSION TIE

FIELD OF THE INVENTION

The present invention generally relates to systems and methods of securing a deck to a house and more particularly to systems and methods for transferring lateral loads from the deck to the house.

BACKGROUND

A deck is structure including a flat surface extending from a house that is capable of serving as a floor and supporting the weight of several people. The deck floor is often elevated above ground level. The floor of the deck is typically outdoors, although in some cases the area above the deck floor is enclosed, or partially enclosed, with screens or light-duty walls having windows. A deck is typically used as an extension of the indoor living space, allowing people to go onto the deck to enjoy a more outdoor environment that is still connected to the house and easily accessible from the inside of the house (e.g. for serving food and drinks to people on the deck).

Residential building codes require connections that transfer lateral loads from the deck to the house. Without sufficient lateral connections to the house, it is possible that a deck may pull away from the house. In some cases movement of people on the deck can result in forces tending to pull the deck away from the housing. Wind and shifts in the ground (e.g., due to settling over time or seismic events) can also result in forces tending to pull the deck away from the house. Lateral movement of the deck away from the house is undesirable because it can cause parts of the deck to become insufficiently supported, which can lead to deck collapse. Thus, building codes currently require builders to install two or four connectors to connect a deck to the adjoining house, depending on the load carrying capacity of the connectors. When using four connectors, each of the connectors must be able to bear 750 pounds of tension to prevent the deck from pulling away from the house.

One example of a conventional connector is illustrated in FIG. 1. A large lag screw 10 extends from a bracket 12 attached to a deck joist 14 and connects the deck joist to a suitable anchor 16 in the house, such as a floor joist, a top plate, or a suitable header. Typically the deck 18 is positioned adjacent a band joist on the house that is not suitable for serving as the anchor for the connection to the house. Thus, the builder must identify a structure farther within the house that is suitable for use as the anchor. Depending on the framing of the house and the deck, there can be variations in the elevation of suitable anchors relative to the deck joist.

The lag screw 10 should extend generally horizontally from the anchor 16. This is not a problem as long as the anchor 16 is horizontally aligned with at least a portion of the deck joist 14 because the bracket 12 for the lag screw 10 can be mounted anywhere vertically along the side of the deck joist. The anchor 16 can also be located slightly under the deck joist 14 because the bracket 12' can be secured to the bottom of the deck joist so the lag screw 10' is under and adjacent the deck joist. However, in some cases the suitable anchors are too low relative to the deck joist to make this type of connection. When this happens, additional materials, such as blocks of wood, and additional fasteners must be used to make the required lateral connection between the deck and the house. This can be costly and time consuming. Also, the need to improvise can sometimes lead to illadvised make-shift solutions that could result in the failure of the connection to resist the specified amount of tension.

The present inventor has developed improved systems and methods of making the required lateral connections between decks and the adjoining houses, which will be described in detail below.

SUMMARY OF THE INVENTION

One aspect of the invention is an adjustable bracket for a tension tie for connecting a deck to a house. The bracket includes a front plate having an opening therein for receiving a connector and legs on opposite sides of the front plate. A brace member is connected to the front plate by a deformation zone at a location intermediate the legs. The front brace has a first resistance to bending and the deformation zone has a second resistance to bending that is lower than the first resistance to bending to facilitate rotation of the front brace relative to the front plate by deformation at the deformation zone.

Another aspect of the invention is a method of connecting a deck to a house using the adjustable bracket described above. The method inserting a connector through the opening in the front plate of the adjustable bracket and then securing the connector to an anchor in the house. The orientation of the brace member is adjusted by bending the adjustable bracket at the deformation zone so the brace member extends from the front plate away from the house to the bottom of a deck joist of the deck. The legs are secured to opposite sides of the deck joist so the legs extend generally vertically upward. The brace member is secured to the deck joist at a location that is spaced farther from the house than the legs of the bracket.

Other objects and features will be in part apparent and in part pointed out hereinafter.

BRIEF DESCRIPTION OF THE DRAWINGS

Corresponding reference characters indicate corresponding parts throughout the drawings.

DESCRIPTION OF THE PREFERRED EMBODIMENTS

Figure 1:
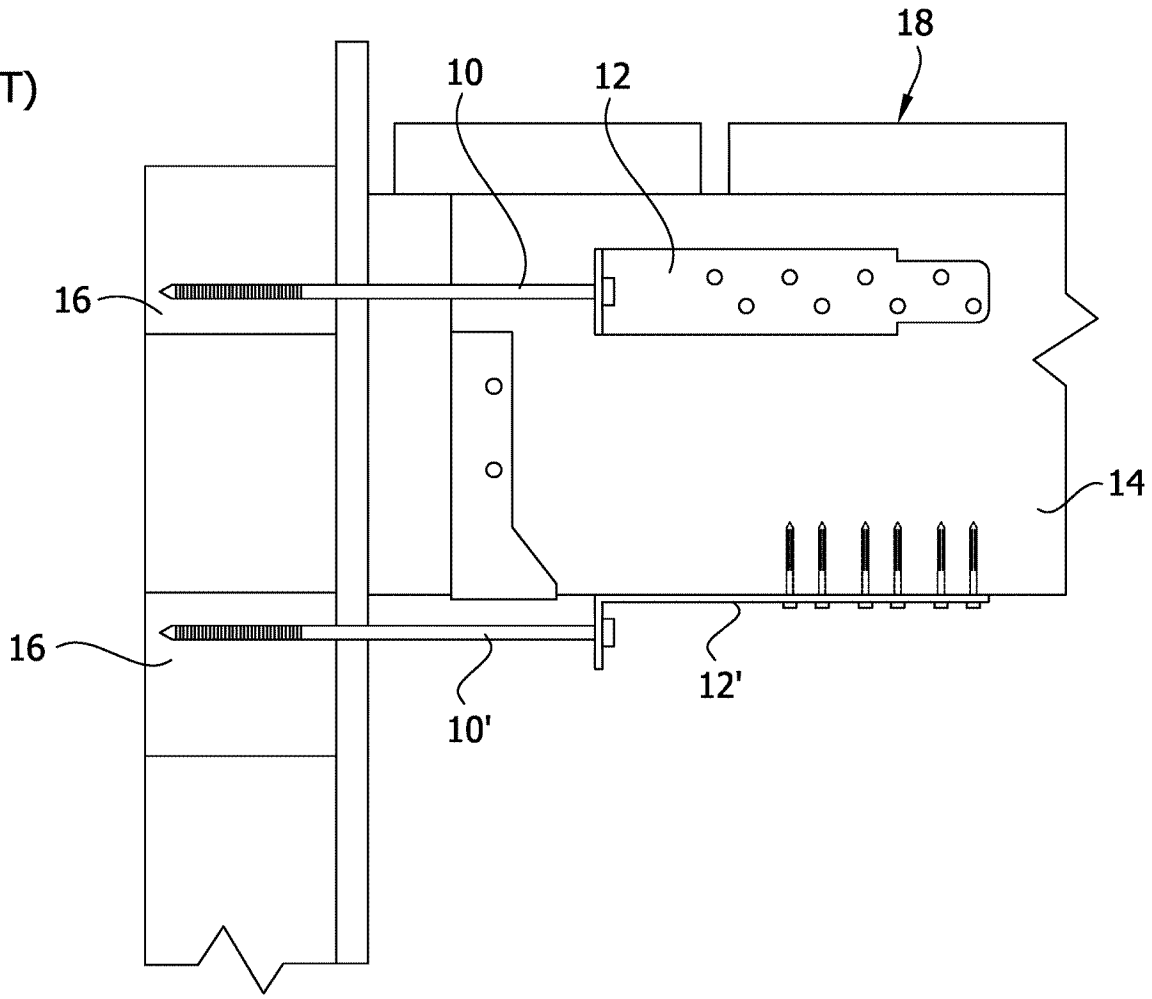
FIG. 1 (PRIOR ART)
FIG. 1 is a schematic illustration of one embodiment of a prior art deck tie installed to establish a lateral connection between a deck joist and an anchor within house.
Figure 2:
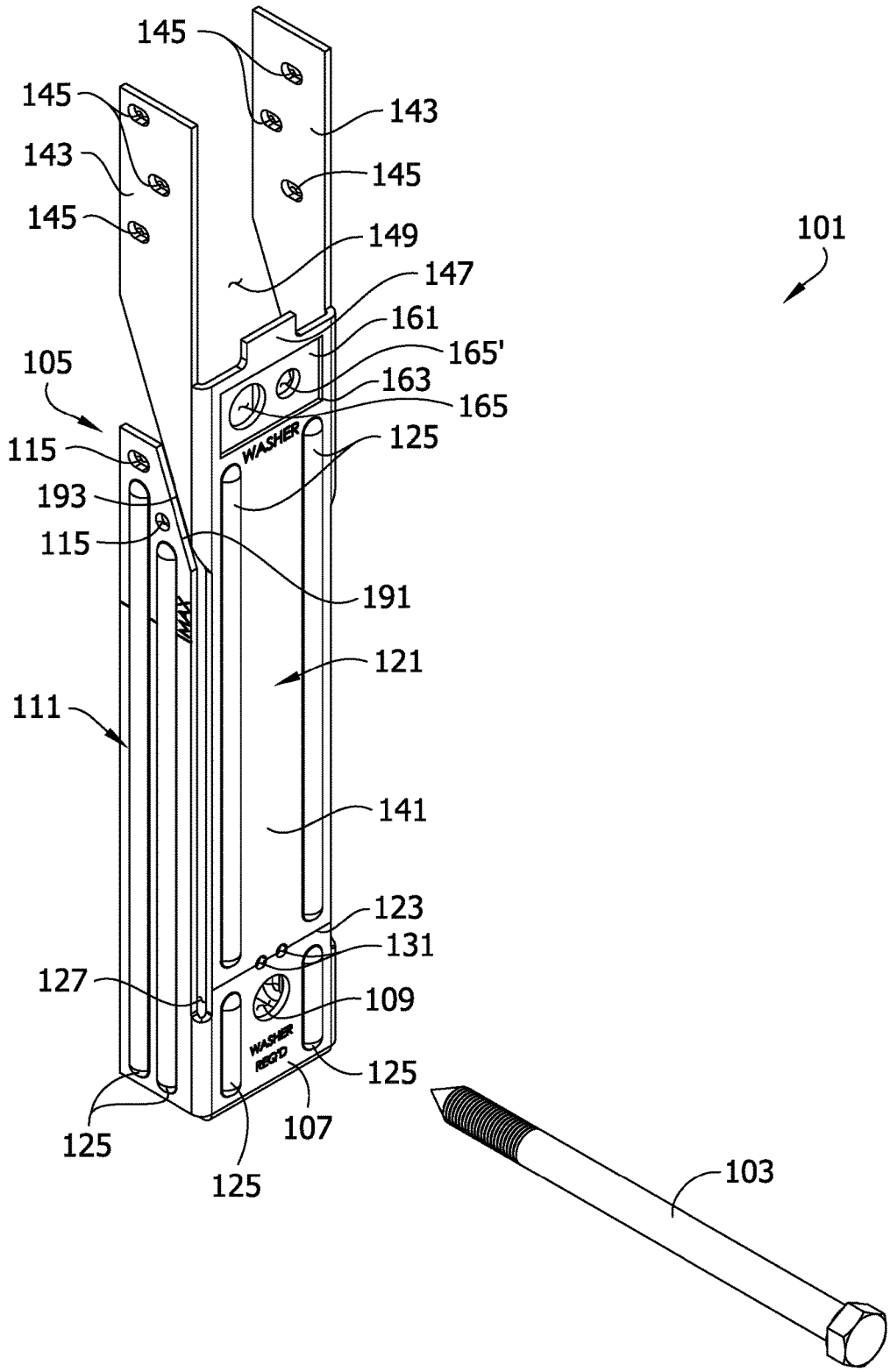
FIG. 2 is a perspective of one embodiment of an adjustable tension tie for use connecting a deck to a house.
Figure 10:
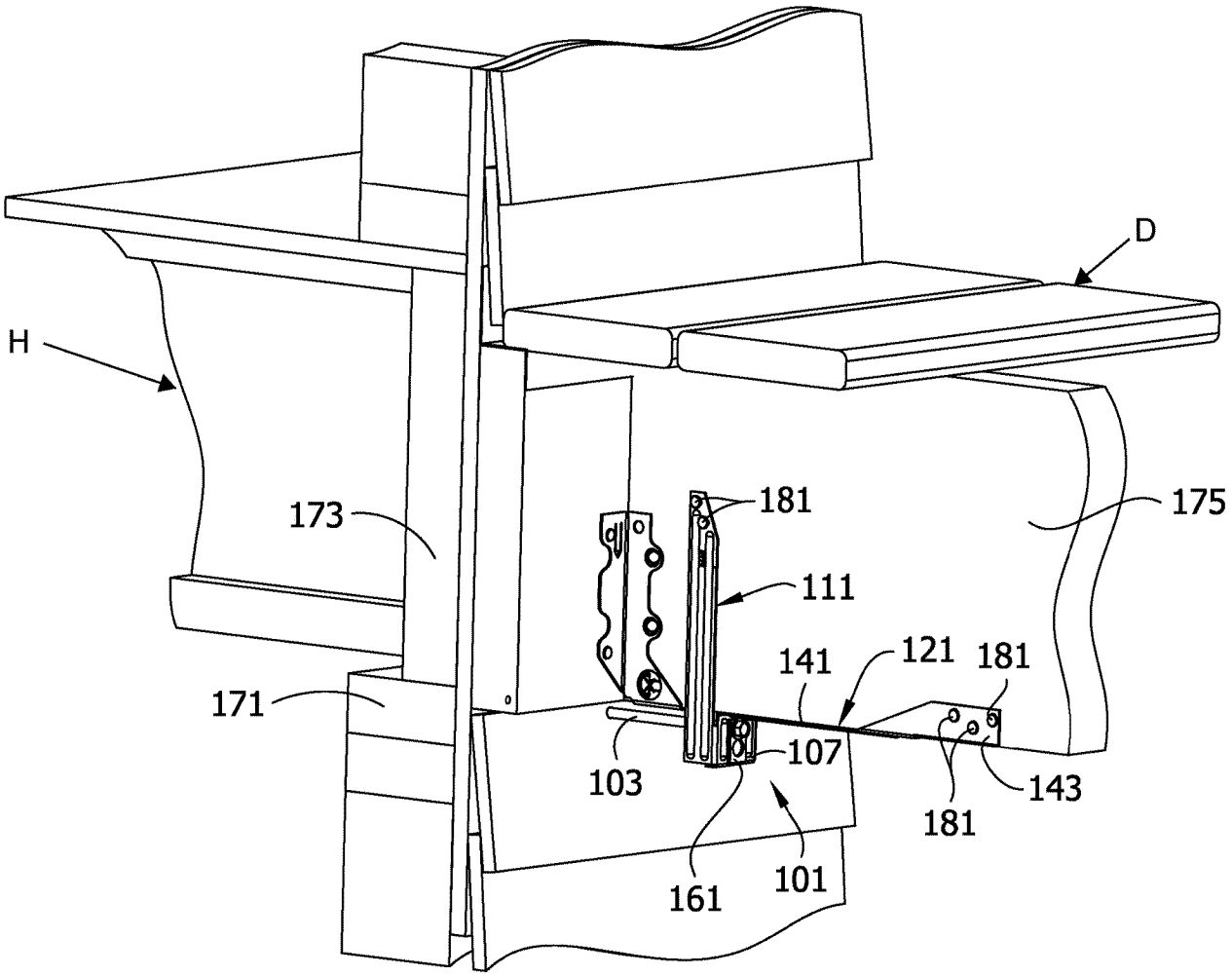
FIG. 10 is a perspective of the adjustable tension tie installed on a deck with the bracket configured for a flush installation.
Figure 11:
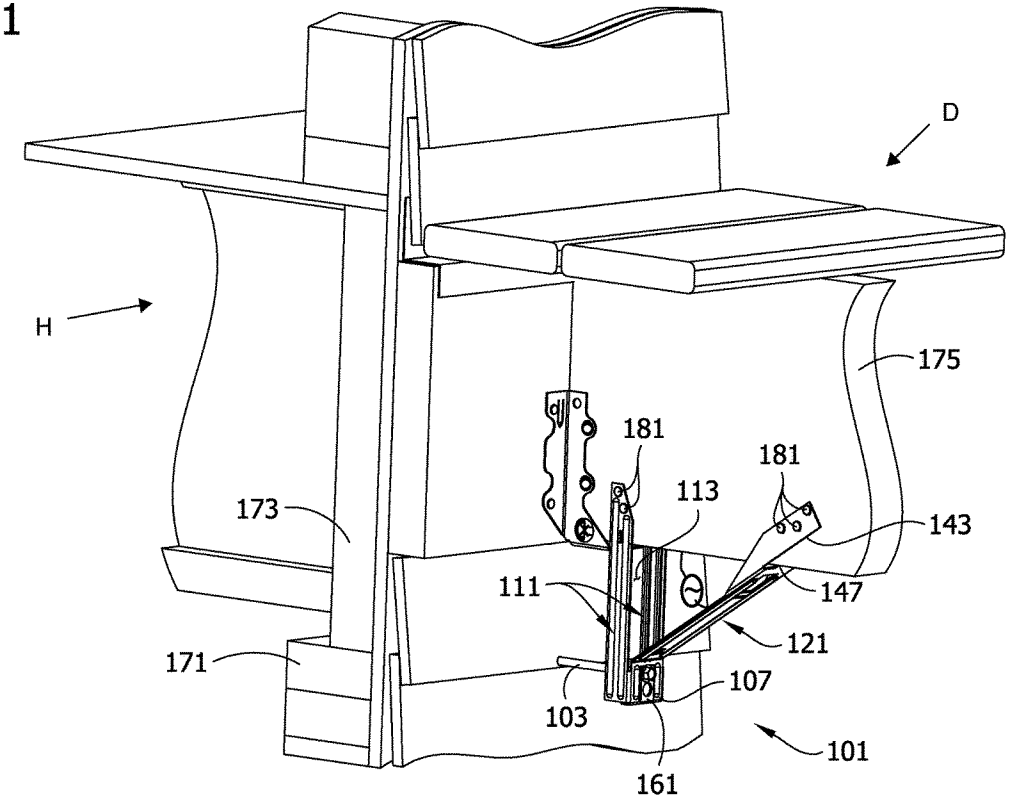
FIG. 11 is a perspective of the adjustable tension tie installed on a deck with the bracket configured for a fully-extended installation.

Referring now to the drawings, first to FIGS. 2, 10, and 11 one embodiment of an adjustable tension tie for making a lateral connection between a deck D and a house H is generally designated 101. The adjustable tension tie includes a connector 103 (e.g., a lag screw or bolt) suitable for making a connection to an anchor in the house or other structure and an adjustable bracket 105 that secures the connector to the deck.

As illustrated in FIGS. 3-8, the bracket 105 has a front plate 107 having an opening 109 therein for receiving the connector 103. A pair of legs 111 are connected to opposite sides of the front plate 107. The legs 111 are suitably mirror images of one another. The legs 111 are substantially orthogonal to the front plate 107 in the bracket illustrated in FIGS. 3-8. The legs 111 are also suitably substantially parallel to one another. The legs 111 have long axes oriented so the long axes are generally parallel to the front plate 107. The front plate 107 is secured to the legs 111 at the bottom of the legs and forms a web of material extending between the legs at the bottom of the legs. The legs 111 are substantially longer than the front plate 107. For example, the length of each of the legs 111 in the illustrated embodiment is about 4-5 times the height of the front plate 107. The legs 111 are suitably at least 4 inches in length. There is an open space 113 between the legs 111 above the front plate for receiving a deck joist (see FIG. 11). The legs 111 are configured to extend along the opposite surfaces of the deck joist when a deck joist in received in the open space 113. The legs 111 suitably have one or more openings 115 (e.g., at their upper ends) to facilitate use of nails, screws, or other fasteners (not shown in FIGS. 3-8) to secure the legs to a deck joist when a deck joist is in the space 113.

Figure 3:
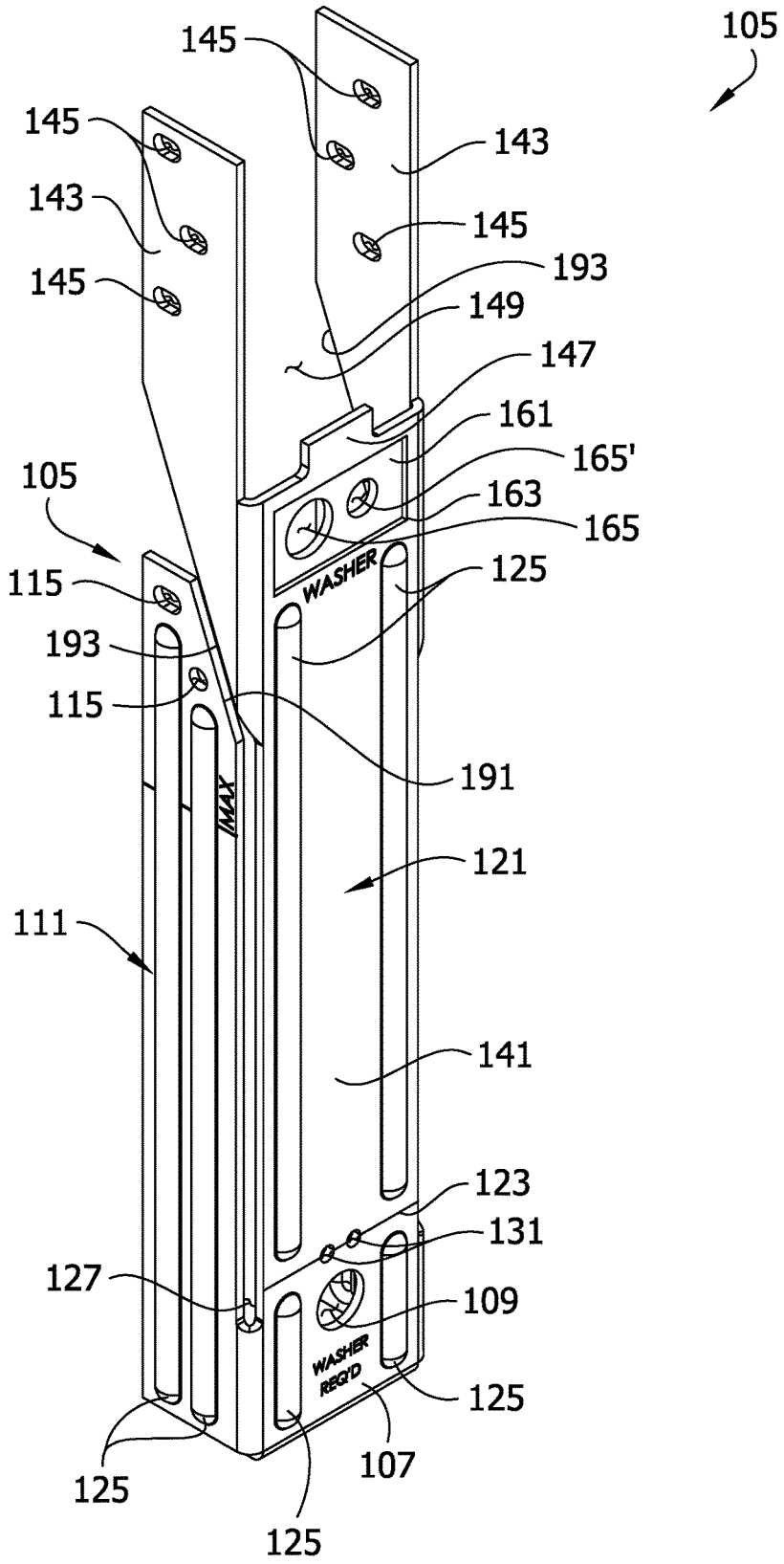
FIG. 3 is a perspective of one embodiment of a bracket of the adjustable tension tie.
Figure 4:
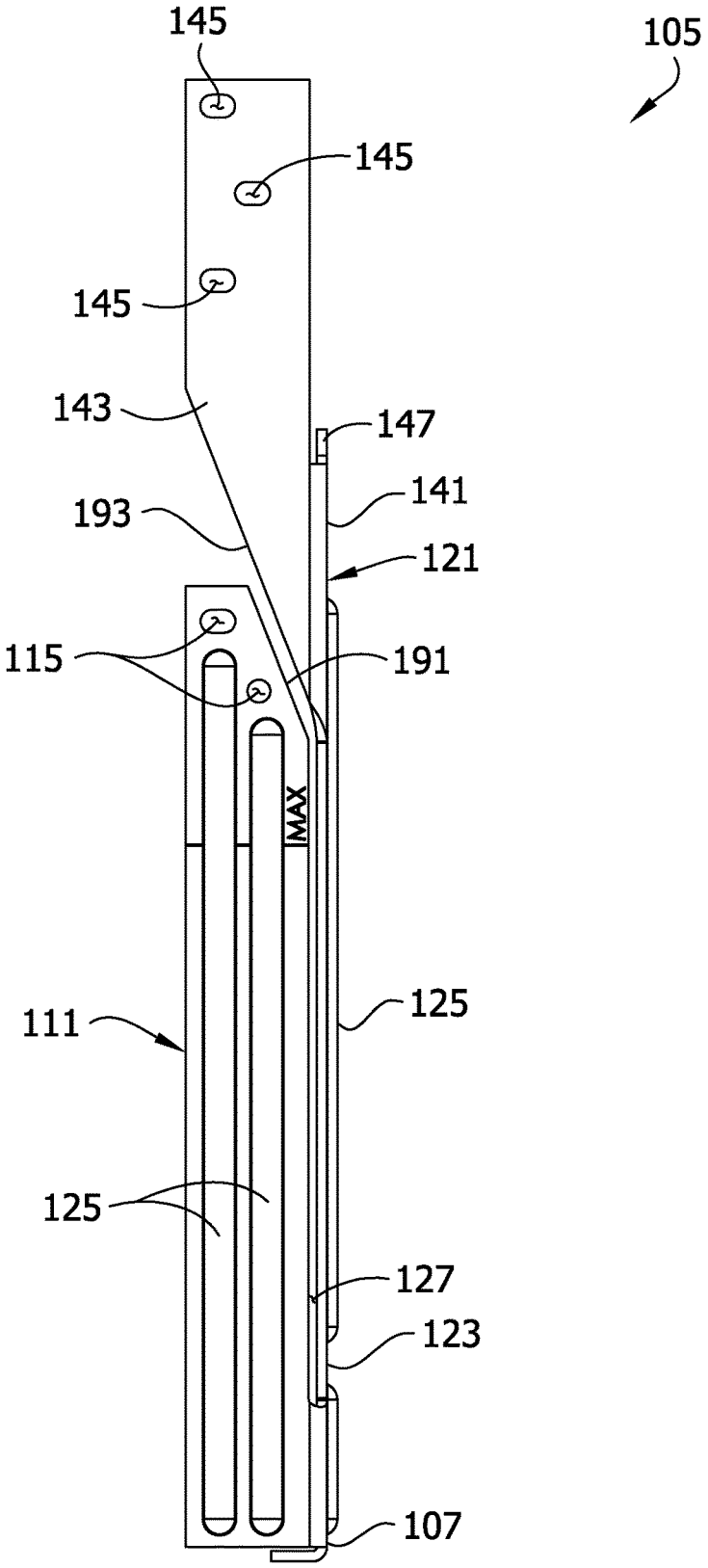
FIG. 4 is side elevation of the bracket illustrated in FIG. 3.
Figure 5:
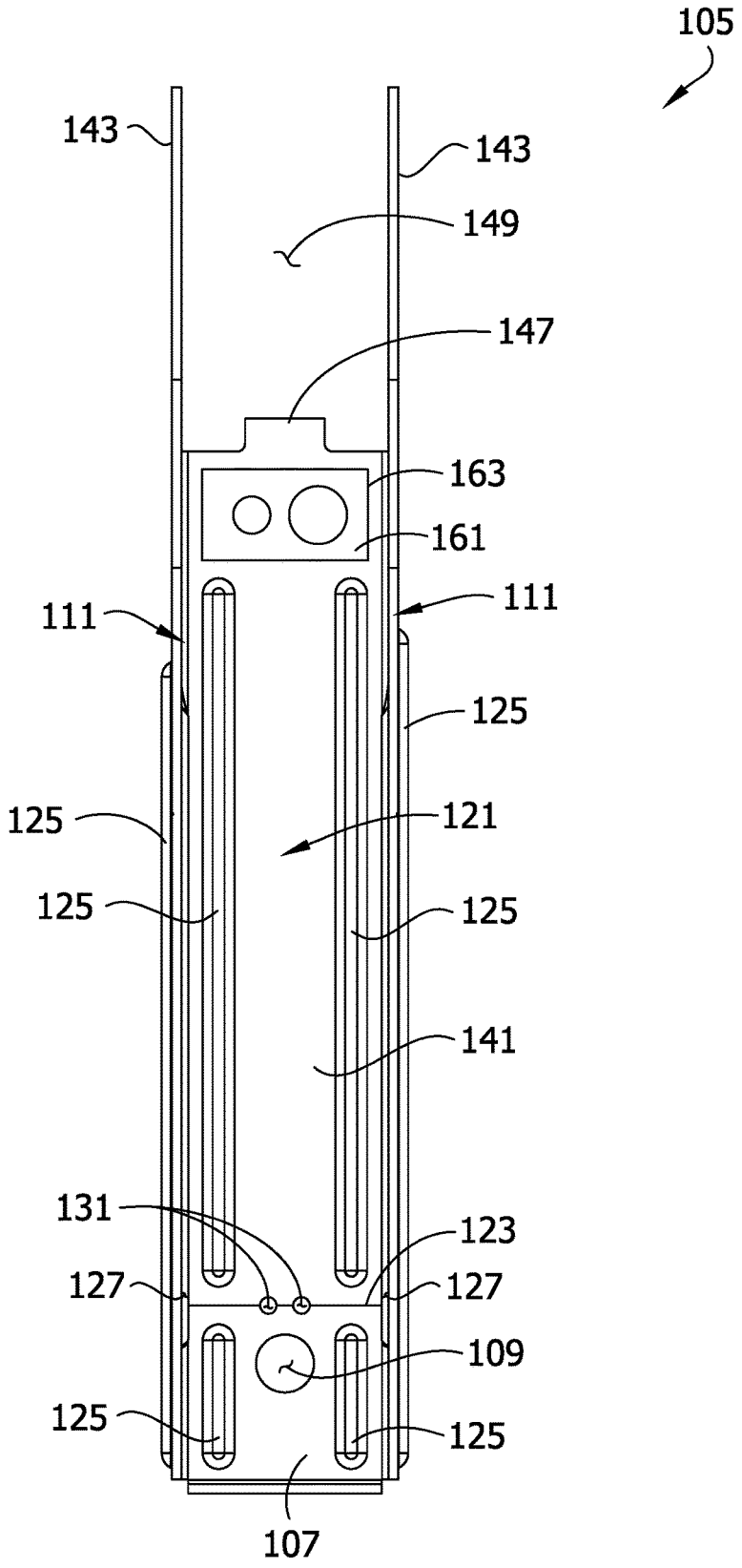
FIG. 5 is a front elevation of the bracket illustrated in FIGS. 3 and 4.
Figure 6:
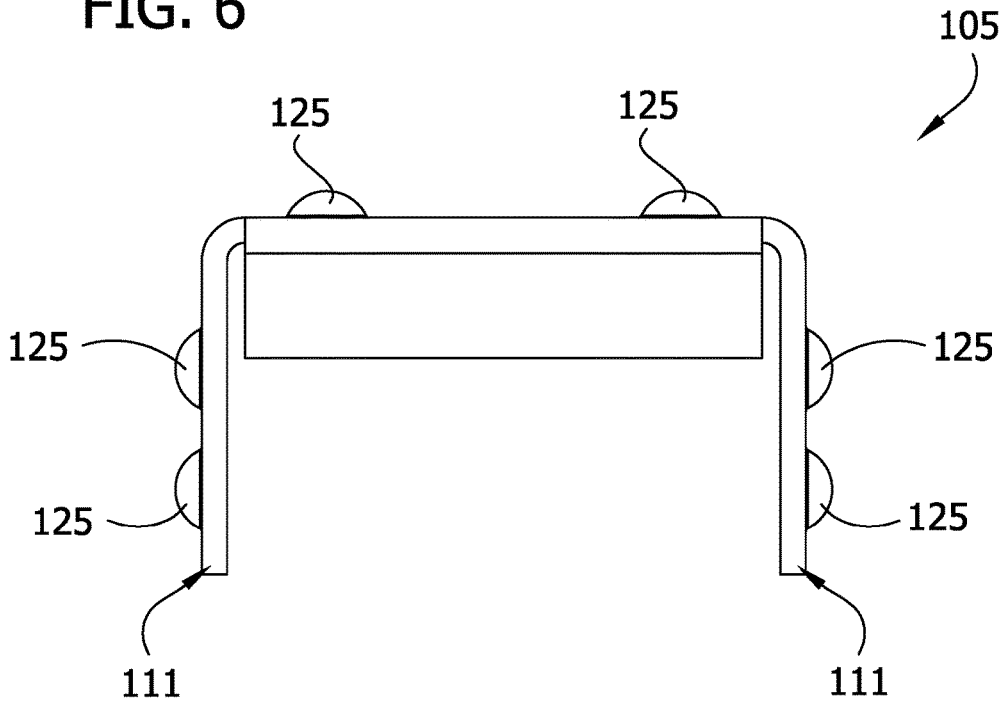
FIG. 6 is a bottom plan of the bracket illustrated in FIGS. 3-5.
Figure 7:
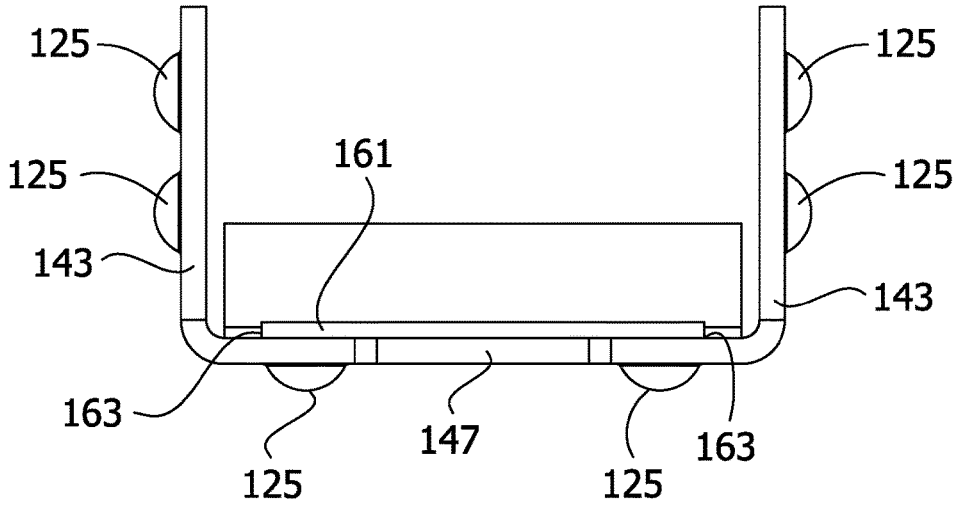
FIG. 7 is a top plan of the bracket illustrated in FIGS. 3-6.

The bracket 105 also has a brace member 121 connected to the upper end of front plate 107 by a deformation zone 123. The brace member 121 includes an elongate brace plate 141 and a pair of arms 143 extending from opposite sides of the plate at an end of the plate opposite the deformation zone 123. In the illustrated embodiment, the arms 143 are mirror images of one another. The arms 143 of the brace member 121 are each generally co-planar with a respective one the legs 111. A tab 147 also extends from the end of the brace plate 141 between the arms 141. The tab 147 is suitably substantially co-planar with the brace plate 141. As illustrated in FIGS. 3, 5, and 6 the arms 143 are generally orthogonal to the brace plate 141 and arranged in substantially parallel opposition to one another. Referring to FIGS. 3 and 4, the arms 143 on the brace member 121 extend beyond the end of the brace plate 141. The arms 143 extend farther away from the deformation zone 123 than the plate 141 of the brace member 121. The arms 143 are spaced from one another by the plate 141 and form a space 149 therebetween for receiving a deck joist (not shown in FIGS. 3-8) so that the arms are on opposite sides of the deck joist and extend along the opposite surface of the deck joist. One or more openings 145 (e.g., three openings in the illustrated embodiment) are provided on each of the arms 143 to facilitate use of nails, screws, or other fastener to secure the arms to the deck joist.

The deformation zone 123 is suitably at a location intermediate the legs 111 and spaced above the lower ends of the legs. In general, the deformation zone 123 is a part of the bracket 105 designed to have relatively lower resistance to bending. For example, the resistance of the bracket 105 to bending at the deformation zone 123 is suitably less than the resistance of the brace member 121 to bending. The resistance of the bracket 105 to bending at the deformation zone is also suitably less than the resistance of the front plate 107 to bending. Those skilled in the art will recognize there are various different ways to design the bracket so there is a deformation zone having relatively lower resistance to bending connecting the front plate to the brace member within the broad scope of the invention.

Referring primarily to FIGS. 3 and 5 for instance, the front plate 107 and brace member 121 suitably have at least one stiffening element 125 thereon that resists bending. For example, at least one stiffening rib 125 (e.g., a pair of stiffening ribs) is suitably formed in each of the front plate 107 and brace member 121. The stiffening ribs 125 extend longitudinally along the brace plate 141 of the brace member 121. The stiffening ribs 125 on the front plate are suitably generally aligned with the stiffening ribs on the brace member 121. The stiffening elements 125 on the brace member 121 are on the opposite side of the deformation zone 123 as the stiffening elements on the front plate 107, which helps make the deformation zone comparatively less resistant to bending. The stiffening ribs 125 are suitably formed as one piece with the rest of the bracket 105 (e.g., in a stamping process), but it is understood that one or more stiffening elements may be formed separately from the rest of the bracket and then attached to the bracket.

The deformation zone 123 suitably has fewer stiffening elements than the brace member 121. The deformation zone 123 suitably has fewer stiffening elements than the front plate 107 as well. For example, in the illustrated embodiment, the deformation zone 123 is substantially devoid of stiffening elements. As illustrated in FIGS. 3 and 5, the ribs 125 on the brace member 121 and front plate terminate as they approach the deformation zone 123 and do not extend across the deformation zone. Thus, the ribs 125 are positioned and configured so they provide no resistance to bending at the deformation zone 123.

The deformation zone 123 can also include features that reduce the resistance of the base material to bending. For instance, the deformation zone 123 in the illustrated embodiment has at least one relief opening 131 formed therein. Referring to FIGS. 3 and 5, there are at least 2 relief openings 131 in the illustrated embodiment. Moreover, the relief openings 131 are oriented on a line extending transversely across the deformation zone 123 between the brace member 121 and the front plate 107. The relief openings 131 weaken the bracket 105 at the deformation zone 123 by removing material from the bracket and causing any bending moments applied to the deformation zone to be concentrated within the remaining material, thereby making the material in the deformation zone more susceptible to yielding in response to bending moments.

One or more stiffening elements 125 (e.g., stiffening ribs) are also on each of the legs 111. For example, each leg 111 in the illustrated embodiment has a pair of stiffening ribs 125. Each leg 111 is suitably separated from the deformation zone 123 by a gap 127 formed in the bracket 105 extending from below the deformation zone 123 up the side of the respective leg. Because the gaps 127 extend below the deformation zone 123, the gaps 127 separate the deformation zone 123 and the brace member 121 from the legs 111 so the legs can be isolated from forces applied to the brace member to produce deformation in the deformation zone for bending the brace member away from the legs.

Figure 9:
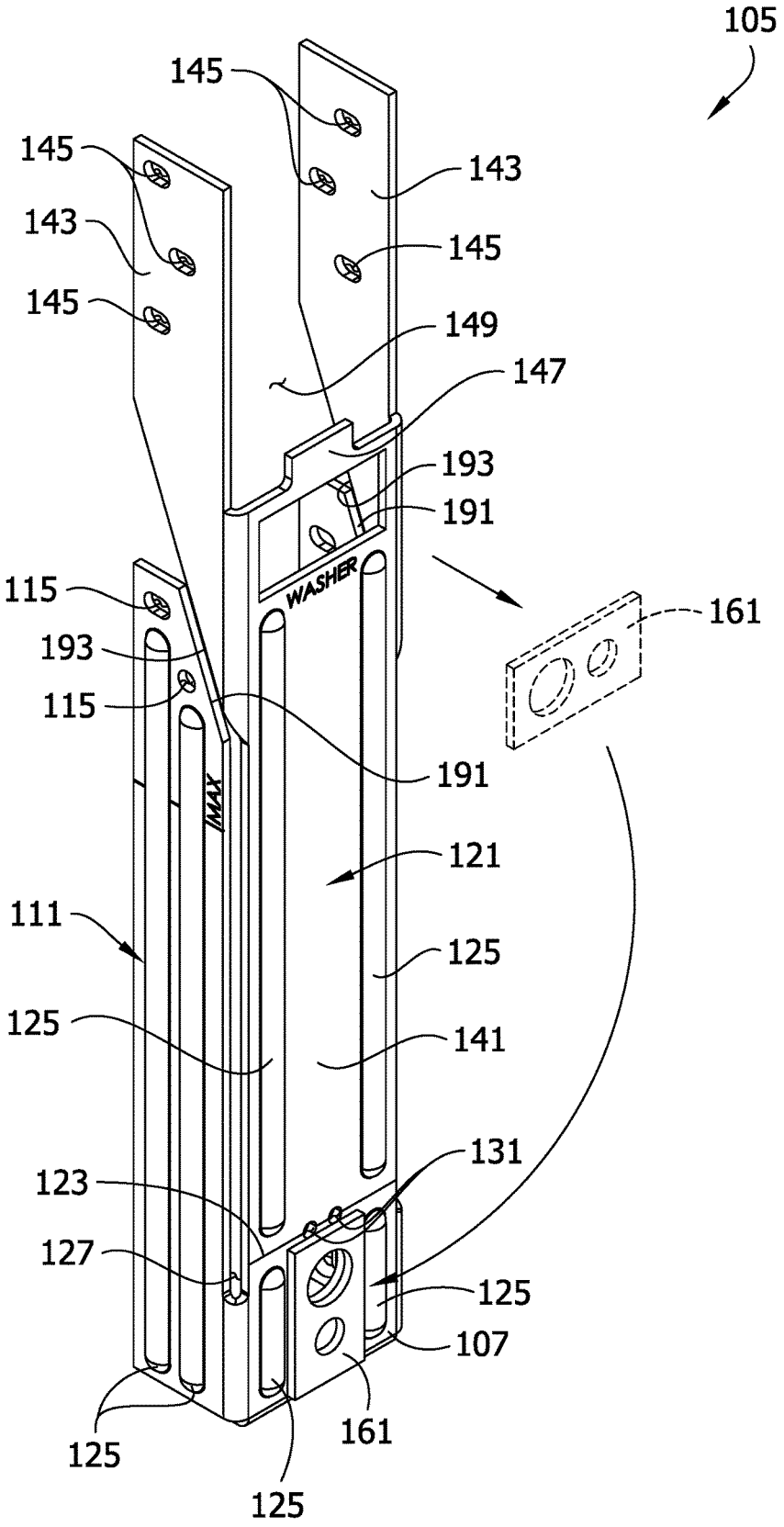
FIG. 9 is an exploded perspective showing a washer being broken off of the bracket.

Referring to FIG. 9, the bracket 105 suitably includes a breakout washer 161, which is a piece of material that is designed so it can be separated from the rest of the bracket during installation and used as a washer between the head of the connector (e.g., lag screw 103) and the front plate 107. For example, the breakout washer 161 is suitably a section of the brace plate having frangible perimeter 163 so that the material within the frangible perimeter can be separated from the rest of the bracket 105 by breaking the frangible perimeter (see FIG. 3). Those skilled in the art will be familiar with various different ways to make a suitable frangible perimeter. There is at least one washer opening 165 for receiving the connector 103 in the breakout washer 161. The washer opening 165 is spaced from the frangible perimeter 163 by material within the frangible perimeter. Thus, a washer 161 can be formed by breaking the frangible perimeter 163 and removing the material within the frangible perimeter from the brace member plate 141. In the illustrated embodiment, there are two washer openings 165, 165' spaced from one another and enclosed by the frangible perimeter 163. The washer openings 165, 165' have different sizes to facilitate use of the bracket 105 and washer 161 with connectors 103 having different dimensions (e.g., diameters).

In the illustrated embodiment, the frangible perimeter 163 has a substantially rectangular shape for making a substantially rectangular washer 161. The two washer openings 165, 165' are suitably positioned generally side-by-side along the long axis of the rectangular-shaped washer 161. One side of the rectangular washer 161 (e.g., the short side) suitably has a length that is about the same as the distance between the stiffening ribs 125 on opposite sides of the opening 115 in the front plate 107. Thus, the washer 161 is shaped so it can be nestled into the space between the front plate stiffening ribs 125. Moreover, in the case in which the distance between the stiffening ribs 125 on the front plate 107 is about equal to the length of the short side of the rectangular washer 161, the washer can be positioned so the ribs 125 are adjacent the long sides of the washer, which can help limit rotation of the washer.

Figure 8:
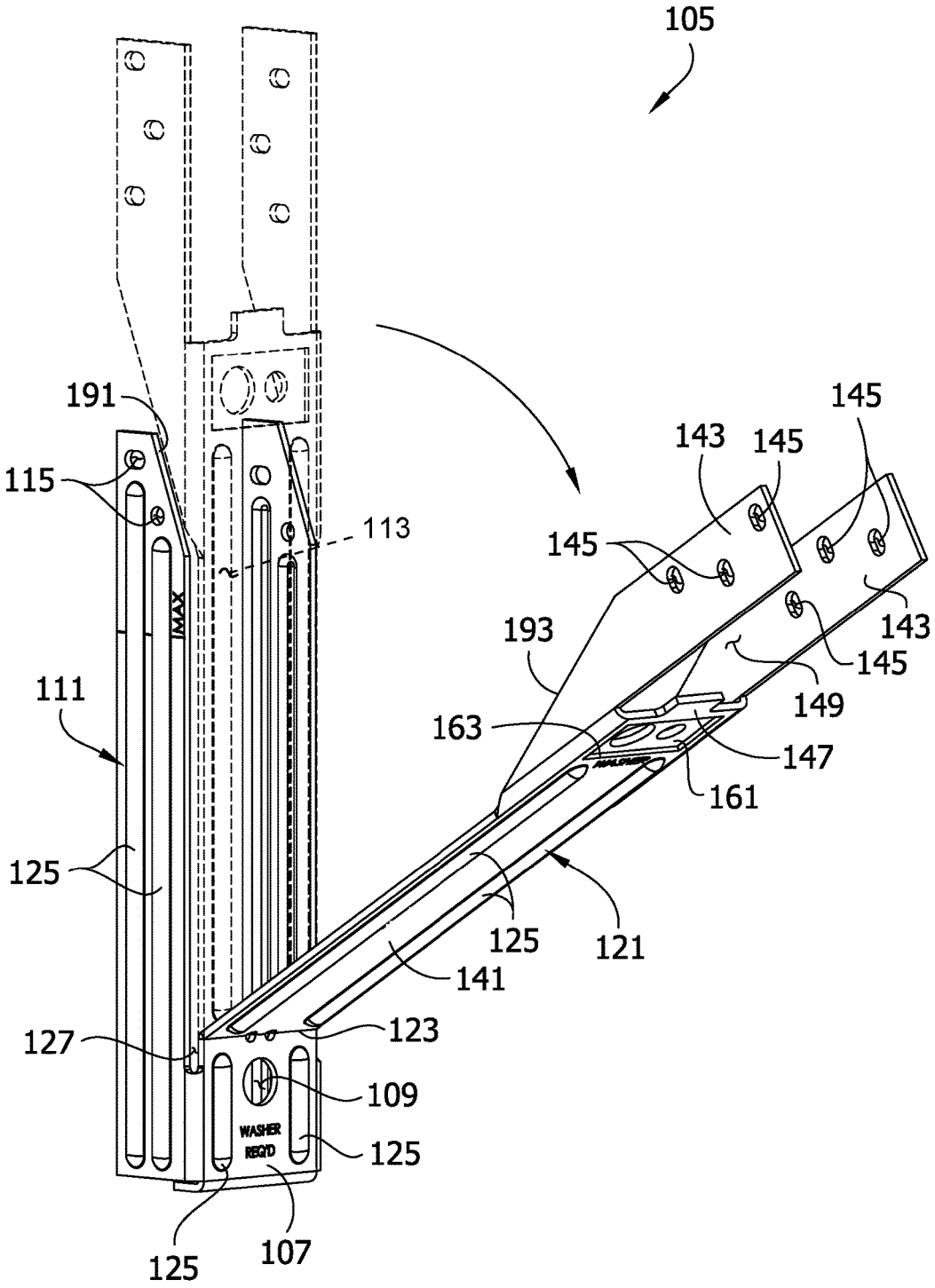
FIG. 8 is a perspective of the bracket illustrated in FIGS. 3-7 showing a sequence in which the bracket is deformed from a first configuration to a second configuration.

One method of using the adjustable bracket 105 to tie a deck to a house will now be described with reference to FIGS. 8-10. This method is for producing a flush installation in which the anchor within the house is horizontally aligned with the area just under a deck joist of the deck. Typically, the first step is to identify a suitable anchor 171 within the house, noting that the band joist 173, which is commonly at about the same level as the deck, is usually not a suitable anchor. The anchor 171 also needs to be generally aligned horizontally with one of the deck joists 175 so the connector 103 can extend from a location under the deck joist to the anchor. The location of the anchor 171 is then marked on the exterior of the house.

A tool or blunt object is used to separate the washer 161 from the rest of the bracket, as illustrated in FIG. 9. The connector 103 is inserted through the most suitable opening 165, 165' in the washer 161 and the opening 109 in the front plate 107 so that the washer is between the head of the connector and the front plate on the side of the front plate opposite the legs 111. This process can include positioning the washer 161 between the ribs 125 on the front plate 107 so that the long sides of the washer abut the inner edges of the ribs. The brace member 121 is rotated relative to the legs 111 in the direction indicated by the arrow A on FIG. 8, such as by grabbing the brace member with one hand near the free end and pulling it forward while holding the legs 111 with the other hand. In order to use the bracket 105 for a flush installation, the brace member 121 is bent all the way forward until it is substantially horizontal when the legs 111 are substantially vertical, as illustrated in FIG. 10. The relative lack of resistance of the deformation zone 123 to bending causes the bracket to bend at the deformation zone to facilitate efforts to substantially avoid permanent deformation of the legs 111 and brace member 121 during the bending process.

The connector 103 is driven generally horizontally into the anchor 171 from the exterior of the house at the location marked to correspond to the anchor. The connector 103 is long enough so that in can extend from the anchor 171 through the framing of the house to a point spaced from the house. For example, the head of the connector 103 is suitably spaced about 4-5 inches away from the house. The connector 103 suitably has a threaded portion that penetrates the anchor 171 at least about 3 inches. The legs 111 of the bracket 105 are arranged so the ends thereof extend substantially vertically along opposite sides of the deck joist 175, which is received in the space 113 between the ends of the legs, and the front plate 107 and washer 161 abut the head of the connector 103. If necessary, the precise angle of the front brace 121 relative to the legs 111 can be adjusted by additional bending to avoid interference with the deck joist 175 during the positioning of the legs. Nails 181 or other suitable fasteners are inserted through the openings 115 in the legs 111 and into the deck joist to secure the legs to the deck joist and hold the legs in this position.

The orientation of the brace member 121 is adjusted by bending the adjustable bracket 105 at the deformation zone 123 so the brace member extends from the front plate 107 away from the house to the bottom of the deck joist 175. For example, the orientation of the brace member 121 is adjusted so the tab 147 at the end of the brace member plate 141 is adjacent the bottom of the deck joist 175. As illustrated in FIG. 10, in the case of a flush installation the deformation zone 123 is bent until the plate 141 of the brace member 121 is substantially orthogonal to the front plate 107 and extends substantially horizontally along the bottom of the deck joist 175 with the plate being substantially flush against the bottom of the deck joist. In this position, the arms 143 of the brace member 121 extend upward along opposite sides of the deck joist 175 and the bottom of the deck joist is received in the space 149 between the arms. Nails 181 or other fasters are inserted through the openings 145 in the arms 111 and into the deck joist 175 to secure the brace member 121 to the deck joist and hold it in this position. If necessary the connector 103 can be driven a short additional distance into the anchor 171 to tighten up the various parts of the adjustable tension tie 101 and securely tie the deck to the house.

As previously noted, it may not always be possible to identify a suitable anchor within the house that will allow a flush installation. FIG. 11 illustrates one embodiment of a the adjustable tension ties 101 in an extended installation, which is suitable for use when the anchor 171 is too far below the deck joist 175 to use a flush installation. Except as noted, the method of using the adjustable bracket 105 in an extended installation is substantially the same as described above. One key difference is that the connector is driven into the house at a location that is up to about 4 to about 4.25 inches below the bottom of the deck joist 175. Because of the lower position of the connector 103 relative to the deck joist 175, the legs 111 will not be able to reach up as high on the sides of the deck joist during the process of securing the legs to the deck joist as they do in the flush installation. However, the legs 111 are long enough to reach a suitable location on the sides of the deck joist 175 for using the nails 181 or other fasteners to secure the legs to opposite sides of the deck joist. Another difference is that the brace member 121 does not need to be positioned as far forward relative to the legs 111 to avoid interference with the deck joist 175 as it does in the flush installation. Thus, the deformation zone 123 does not need to be deformed to the same extent needed for a flush installation. When the tab 147 on the end of the plate 141 of the brace member 121 is adjacent the bottom of the deck joist 175 and the front plate abuts the washer 161 and the head of the connector 103, the brace member will extend up from the front plate 107 at an angle θ relative to the deck joist to a location on the deck joist spaced farther from the house than the legs 111 are spaced from the house. The arms 143 of the brace member 121 are nailed or otherwise secured to the opposite sides of the deck joist 175 by inserting nails or other fasteners into the deck joist through the openings 145 in the arms to hold the brace member in this angled position.

The amount of deformational bending of the deformation zone 123 can be adjusted to position the brace plate 141 and arms 143 of the brace member 121 at any angle relative to the deck joist between the angle θ (FIG. 11) of the fully-extended installation and the angle of about 0 in the flush installation (FIG. 10). Thus, the bracket 105 provides infinite adjustability to accommodate any location of the anchor 171 (and relatedly any location of the connector 103) between the location of the anchor in the flush installation and the location of the anchor in the fully-extended installation. In other words, the methods described above can be easily adapted to make a lateral connection between the deck and the house using the adjustable tension tie 101 and an anchor 171 positioned within the house at any elevation between the elevation of the anchor in FIGS. 10 and 11, just by changing the amount of deformation of the deformation zone 123 and the angle of the brace member 121 relative to the deck joist 175.

Figure 12:
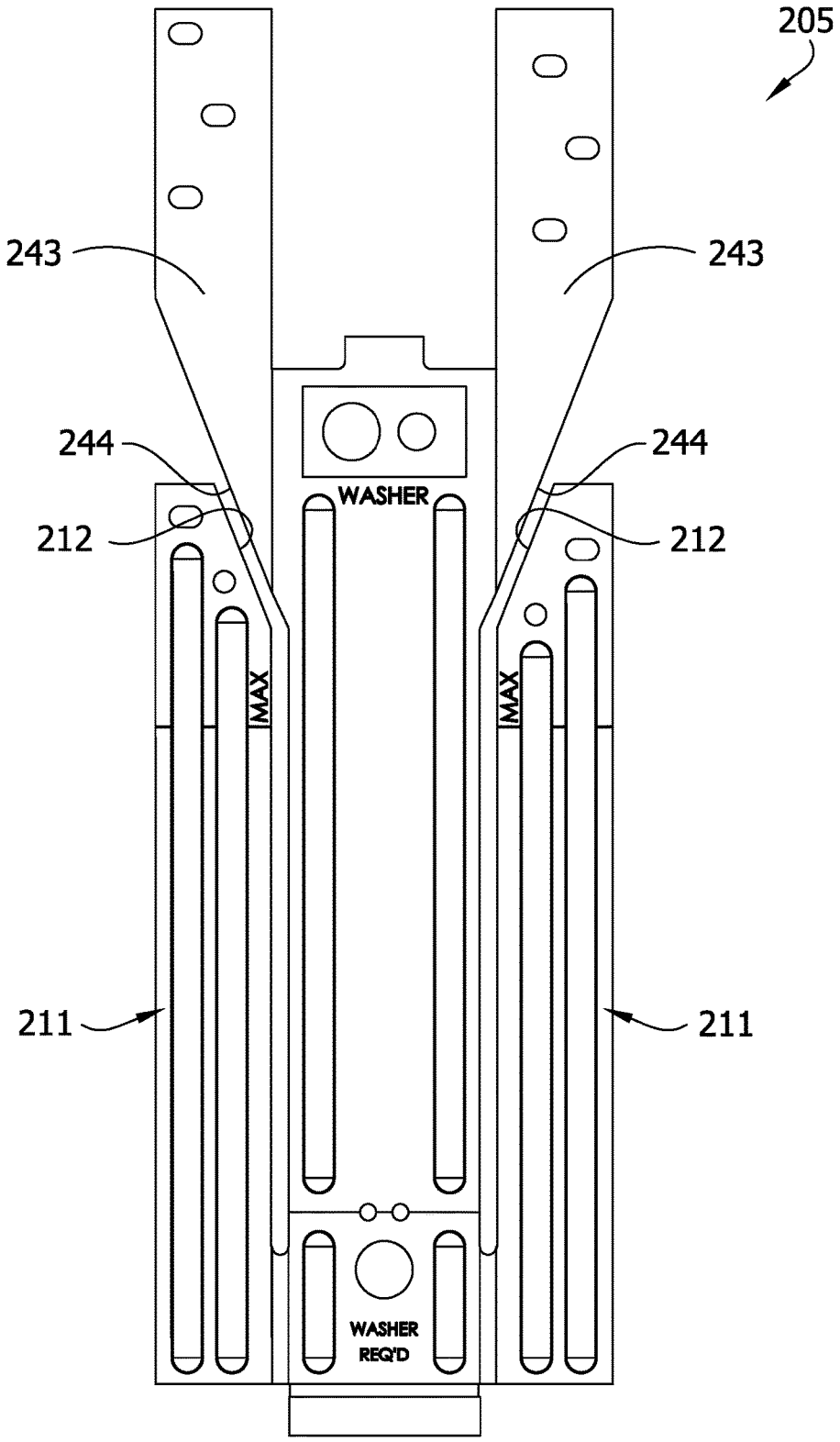
FIG. 12 is a top plan of stamped piece of sheet metal showing one embodiment of a layout for producing the bracket illustrated in FIGS. 3-7 from sheet metal.

FIG. 12 illustrates one embodiment of a generally flat blank of material 205 that is suitable for being formed into the adjustable bracket 105 illustrated and described above. Several features of the bracket 105 facilitate the ability to form the bracket from a single sheet of material. For example, the arms 143 of the brace member 121 taper from a wider width at their distal ends to a narrower width at their proximal ends. Also, the legs 111 of the bracket taper from a narrower width at their distal end to a wider width proximally of the distal end. One advantage of this arrangement is that the tapered end portions 212 of the leg-forming portions 211 of the blank 205 are adjacent to the tapered portions 244 of the corresponding arm-forming portions 243 of the blank, which facilitates use of less material to make the blank. Because the taper angles for the tapered portions 212, 244 generally match one another, the shape on at least a portion of the legs 111 of the fully-formed bracket 105 is complementary to the shape on at least a portion of the arms 143 of the fully-formed bracket. For example, the tapers on the distal ends 191 of the legs 111 are complementary in shape to the tapers on the proximal ends 193 of the arms 143 to facilitate a layout in which the bracket is formed by bending a single generally flat blank 105 of material into the shape of the bracket 105.

Having described the invention in detail, it will be apparent that modifications and variations are possible without departing from the scope of the invention defined in the appended claims.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions, products, and methods without departing from the scope of the invention, it is intended that all matter contained in the above description and shown in the accompanying drawings shall be interpreted as illustrative and not in a limiting sense.

What is claimed is:

1. An adjustable bracket for a tension tie for connecting a deck to a house, the bracket comprising:

a front plate having an opening therein for receiving a connector;

legs on opposite sides of the front plate; and a brace member; and a deformation zone connecting the brace member to the front plate at a location intermediate the legs, the brace member having a first resistance to bending and the deformation zone having a second resistance to bending that is lower than the first resistance to bending to facilitate rotation of the brace member relative to the front plate by deformation at the deformation zone, wherein the legs are attached to the front plate at locations on an opposite side of the deformation zone as the brace member.

2. The adjustable bracket as set forth in claim 1 wherein the brace member comprises at least one stiffening element that resists bending.

3. The adjustable bracket as set forth in claim 2 wherein the deformation zone is devoid of stiffening elements.

4. The adjustable bracket as set forth in claim 3 wherein the front plate has at least one stiffening element on an opposite side of the deformation zone as said stiffening element of the brace member.

5. The adjustable bracket as set forth in claim 1 wherein the deformation zone has at least one relief opening to make the material in the deformation zone less resistant to bending.

6. The adjustable bracket as set forth in claim 1 wherein the brace member comprises an elongate brace plate and arms extending from opposite sides of the plate at an end of the plate opposite the deformation zone.

7. The adjustable bracket as set forth in claim 6 wherein the arms are generally orthogonal to the brace plate and arranged in opposition to one another.

8. The adjustable bracket as set forth in claim 7 wherein the arms extend beyond the end of the brace plate.

9. The adjustable bracket as set forth in claim 8 wherein the arms taper from a wider width at their distal ends to a narrower width at their proximal ends.

10. The adjustable bracket as set forth in claim 9 wherein the legs of the bracket taper from a narrower width at their distal end to a wider width proximally of the distal end, the tapers on the ends of the legs having a shape that is complementary to at least a portion of the tapers on the ends of the arms of the brace member.

11. The adjustable bracket as set forth in claim 1 wherein the brace member comprises a breakout washer formed by a section of the brace member having a frangible perimeter, the section of the brace member within the frangible perimeter having a washer opening for receiving the connector, the washer opening being spaced from the frangible perimeter by material within the frangible perimeter so that a washer can be formed by breaking the frangible perimeter and removing the material within the frangible perimeter from the brace member.

12. The adjustable bracket as set forth in claim 11 wherein the front plate has stiffening ribs on opposite sides of the opening for the connector, the frangible perimeter having a rectangular shape, wherein a distance between the stiffening ribs is about equal to a length of one side of the rectangular shape of the frangible perimeter.

13. The adjustable bracket as set forth in claim 11 wherein the washer opening is a first washer opening, the breakout washer further having a second washer opening, the first washer opening being larger than the second washer opening to facilitate use of the washer with connectors having various different dimensions.

14. The adjustable bracket as set forth in claim 1 wherein the legs are attached to opposite sides of the front plate.

15. The adjustable bracket as set forth in claim 1 wherein the brace member is moveable independently of the legs by deformation at the deformation zone.

16. The adjustable bracket as set forth in claim 1 wherein the legs and brace member are free of direct attachment to one another.

17. A tension tie installation for connecting a deck to a house, the tension tie installation comprising the adjustable bracket as set forth in claim 1 in combination with the connector, wherein the connector extends generally horizontally through the opening in the front plate and into an anchor in the house to secure the adjustable bracket to the house and the legs and brace member are secured to the deck to connect the deck to the house.

18. A tension tie installation as set forth in claim 17 wherein the connector is adjacent a bottom of a deck joist and the brace member has been oriented generally orthogonally to the front plate by deformation of the deformation zone so the brace member extends generally horizontally from the front plate of the bracket away from the house along and adjacent to the bottom of the desk joist.

19. A tension tie installation as set forth in claim 17 wherein the connector is spaced a distance from the a bottom of a deck joist and the brace member is oriented at a non-orthogonal angle by deformation of the deformation zone so that the brace member extends angularly upward from the front plate of the bracket to the bottom of the deck joist.

* * * * *